US008443748B2

(12) United States Patent
Stanley

(10) Patent No.: US 8,443,748 B2
(45) Date of Patent: May 21, 2013

(54) DOCKING AID APPARATUS WITH UTILITY IMPLEMENT

(76) Inventor: Robert Stanley, Louisville, KY (US)

( * ) Notice: Subject to any disclaimer, the term of this patent is extended or adjusted under 35 U.S.C. 154(b) by 158 days.

(21) Appl. No.: 12/973,824

(22) Filed: Dec. 20, 2010

(65) Prior Publication Data

US 2012/0152161 A1 Jun. 21, 2012

(51) Int. Cl.
*B63B 21/00* (2006.01)

(52) U.S. Cl.
USPC ..... 114/230.1; 114/221 R

(58) Field of Classification Search
USPC ..... 114/221 R, 230.1, 230.15, 230.17, 114/230.18, 230.25, 230.26; 294/119.2; 441/80
See application file for complete search history.

(56) References Cited

U.S. PATENT DOCUMENTS

| | | | |
|---|---|---|---|
| 3,861,346 | A | 1/1975 | Pina |
| 3,993,013 | A | 11/1976 | Nunziato et al. |
| 5,398,634 | A | 3/1995 | Eagan |
| 5,586,514 | A | 12/1996 | Yuscavage |
| 5,634,421 | A | 6/1997 | Velarde |
| 5,799,602 | A | 9/1998 | Trillo |
| 5,967,575 | A | 10/1999 | Blake |
| 6,085,681 | A | 7/2000 | Morton |
| 6,659,033 | B1 | 12/2003 | Donley |
| 6,928,945 | B1 | 8/2005 | Tebo, Jr. |
| 7,712,804 | B2 | 5/2010 | Leyden et al. |
| 7,717,053 | B2 | 5/2010 | Jayne |
| 2004/0237867 | A1 | 12/2004 | Dunn |
| 2005/0061223 | A1 | 3/2005 | Carr |

*Primary Examiner* — Lars A Olson
(74) *Attorney, Agent, or Firm* — Waters Law Group, PLLC; Robert R. Waters; Brian W. Foxworthy

(57) ABSTRACT

This invention is for a docking aid to help dock a boat to a docking post, or to pull a boat closer to the shore. It comprises of a shaft and a tensile member. The tensile member may pass through the shaft and form one or more loops at the ends of the shaft. One loop may be used to dock to a docking pole, while a second loop may be used as a handle to pull, or to loop around another docking element. At least one loop may have a utility implement with an attached tool. This tool may be used to grab a docking post from a boat, to grab an inbound boat from a dock, to pull closer to a second boat, or to grab objects out of the water that may have fallen overboard. The docking aid may also be floatable.

14 Claims, 7 Drawing Sheets

DOCKING AID APPARATUS WITH UTILITY IMPLEMENT

BACKGROUND OF THE INVENTION (a) Technical Field of the Invention

The present invention relates to a docking or mooring apparatus used to safely reach and pull to a dock or to a second boat, in a safe, controlled and extended manner. The dock or the second boat may be equipped with different docking elements, such as a piling, a cleat, a ring, or some other element. These docking elements may also be at different heights. Many docking apparatus comprise of loops made of material such as rope, therefore requiring some skill and dexterity on the part of the boat-crew to actually be able to dock. Some docking apparatus also require a person to be on the dock to enable the docking Some significant drawbacks of the prior art apparatus are that most of them are capable of attaching to only one kind of docking element; or the apparatus provide loops of a fixed size; or the loops hang if not supported. Even in situations where these issues are addressed one at a time, the connection between the docking portion of the apparatus and the portion that is pulled on by a boat operator may not be direct. This may increase wear and tear of the apparatus from the resulting tensile forces. Also, an operator of a boat may not be aware of the particular docking element she might encounter at the next dock. This creates an unmet need for a docking apparatus capable of having multiple docking attachments to enable docking safely with different docking elements. These attachments must be secured in a manner to effectively transfer the tensile forces to the tensile member without allowing the forces to cause unnecessary wear and tear at the weak points of the apparatus. In addition to a novel solution to these problems, the present invention also addresses other issues in the prior art, to provide a superior, lightweight, inexpensive, durable, multi-purpose docking apparatus, which may also be floatable. Another very important and favorable use is around areas of boat congestion. This could be around fuel docks where someone extends assistance from the dock to the boats. A person at the dock usually grabs the cleat of an inbound boat to pull it in. Such a person on the dock may now use this docking aid to get the inbound boat pulled closer to the fuel dock to tie off more safely and quickly. This docking aid will give this person greater reach and control, especially in areas of congestion. This new docking aid is therefore suitable for extended reaching and pulling to a dock or another boat in a safe and controlled manner.

(b) Description of the Relevant Art

When a boat or watercraft nears a dock, including fuel docks, or another vessel, the operator of the boat has to moor it by attaching it to a docking element on the dock or the second vessel. This is usually achieved by throwing a rope made of suitable marine material so that it loops around a cleat, or a piling (either standing independently, or connected to a dock). This method of docking either requires some dexterity on the part of the operator of the boat, or it requires a second person who can help put a loop around the docking element. This may be either due to the tendency of the vessel to drift, or it may be in areas of boat congestion. Given the small interval of time available to successfully dock the boat under such circumstances, this hit-and miss method is inefficient, and under certain conditions of high wind and/or swift currents, could also be dangerous. Thus, there is a need for a docking aid apparatus which may aid in pulling closer to the dock in a safe and controlled manner. Such an apparatus must have an extended reach, and be sufficiently strong to be able to pull a boat closer to the dock.

Many apparatus in the prior art enclose part of the rope in a suitable tube that offers some rigidity. Such a rigid tube also forces a certain minimum distance between the boat and the dock or second vessel, thereby reducing damage from possible collisions. Some apparatus with loops and/or tubular elements are disclosed in U.S. Pat. No. 7,717,053 by Jayne, U.S. Pat. Pub. No. 2004/0237867 by Dunn, U.S. Pat. No. 5,634,421 by Velarde, U.S. Pat. No. 5,586,514 by Yuscavage, and U.S. Pat. No. 5,398,634 by Eagan. In some instances, these tubular elements may be designed to be telescoping to afford some flexibility as to the distance between the boat and the docking element. A floatable apparatus with a telescoping element is disclosed by Nunziato, et al. in U.S. Pat. No. 3,993,013.

Another common problem encountered by operators of boats and other watercrafts is the difference in the physical dimensions of the docks. For instance, some pilings may be too tall to be successfully looped from a boat. The prior art has some apparatus that solve this problem by using either a docking fork, such as the one taught by Trillo in U.S. Pat. No. 5,799,602; a mooring hook, as disclosed by Morton in U.S. Pat. No. 6,085,681; an apparatus with a Y-like member as disclosed by Donley in U.S. Pat. No. 6,659,033; or an apparatus for grabbing a hook, as taught by Blake in U.S. Pat. No. 5,967,575.

A watercraft mooring apparatus with a clasp connected to a loop is disclosed by Eagan in U.S. Pat. No. 5,398,634. This apparatus consists of two loops. One loop is connected to a watercraft mooring member and the other loop is connected to a dock mooring member. The loops are formed from a single length of rope, by enclosing the portion of the rope between the loops in an elongated shaft. One end of the rope is secured in the interior bore of the elongated shaft, while the other end comes out of the elongated shaft through a sidewall hole. The two ends of the tube are suitably capped. One or both loops may have a closable clasp connected to it. Two major drawbacks of this apparatus are that the tensile forces acting on the rope may rupture the tubular element. Also, the clasp is not securely connected to the loop, thereby requiring manual intervention to secure the clasp to the mooring element. The clasp is primarily intended to connect the loop to a mooring member in the shape of a closed ring. This apparatus also does not allow for other attachments to be securely connected to the loop or loops.

The patents mentioned above fail to adequately solve the problems associated with docking a boat. Many patents in the art are directed to long-term mooring of the craft, as opposed to acquiring initial contact with a docking element. It is desirable that a docking aid be adaptable to different docking environments and aid in acquiring the initial contact with a docking element. It is also desirable that the docking aid have multipurpose utility.

SUMMARY OF THE INVENTION

The present invention preserves the advantages of the apparatus in the prior art, and improves upon them. In addition, it provides one or more self supporting loops formed from a tensile member. The loops may have attachments that are securely and firmly fastened to accommodate multipurpose use. The stiffness of the loop and the fastening allows the loop and the attachment to be used from a distance, without the need for a person to manually connect the attachment to a docking element. It also removes the need for the loop to be thrown around a piling in a hit-or-miss process. In at least one embodiment, the tensile member may pass through a hollow shaft to form loops at either end of the shaft, thereby allowing the tensile forces to pass through the tensile member and be transferred between the docking element and the operator. This substantially reduces the wear and tear at the weak points of the docking apparatus, making it more durable. This invention is therefore a substantial improvement over the apparatus of the prior art.

One embodiment of the invention consists of an elongated shaft with a self-supporting loop made of tensile member at one end. The loop may be formed by fixing both ends of the tensile member to the body of the shaft, or to the body of the tensile member itself. The tensile member is sufficiently stiff such that the loop maintains its form when extended horizontally, and does not hang or otherwise deform, as a simple rope would. The loop may have a utility implement with an attached utility tool such as a hook, a closable clasp, a clamp that hooks and unhooks, or a pair of jaw members that close around a mooring member. This tool may be interchangeable. The utility tool may be used, for instance, to pull closer to the dock; to pull alongside another watercraft; or to clamp onto a docking pile where the loop may not be effective as a docking aid. The tool may also be used to retrieve objects from the water that have fallen overboard. In some embodiments, the elongated shaft is hollow and the tensile member may pass through this shaft. The tensile member may form a handle or another self-supporting loop, at the other end of the elongated shaft. This second self-supporting loop may be used as a handle to maneuver the docking apparatus, or to pull. The handle may be padded for added comfort and for an improved grip. This second loop may also be used to connect to the mooring member on the watercraft or boat. An important and favorable use may be around areas of boat congestion. This could be around fuel docks where someone extends assistance from the dock to the boats to get them pulled closer to the fuel dock to tie off more safely and quickly.

These and other features, variations and advantages which characterize this invention, will be apparent to those skilled in the art, from a reading of the following detailed description and a review of the associated drawings.

Additional features and advantages of this invention will be understood from the detailed descriptions provided. This description, however, is not meant to limit the embodiments, and merely serves the purpose of describing some structural embodiments.

BRIEF DESCRIPTION OF THE DRAWINGS

A better understanding of the present invention will be had upon reference to the following description in conjunction with the accompanying drawings, wherein.

DETAILED DESCRIPTION OF EMBODIMENTS

This apparatus aids in docking a boat without assistance from the shore, and without having to disembark to manually aid in the docking While the invention will be described in connection with certain embodiments, there is no intent to limit the invention to these embodiments. On the contrary, the intent is to cover all alternatives, modifications and equivalents as included within the spirit and scope of the invention. Various changes may be made to the function and arrangement of the elements described herein, without changing the scope of the invention being disclosed. It should be noted that the following description serves to teach at least one instance of how the various elements may be arranged to achieve the stated goals of this invention.

Figure 1:
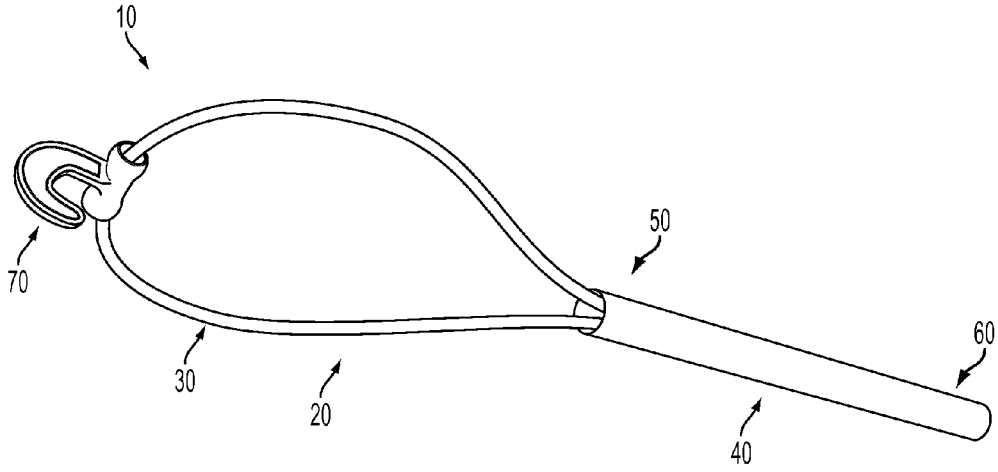
FIG. 1 shows the docking aid apparatus with a shaft, a loop, and a utility implement with an attached tool—in this case, a hook, in deployed position.

With reference to FIG. 1, a docking aid apparatus 10 may be used to acquire connection to a docking pole or another watercraft. The apparatus may also be used to grab a distant docking pole or another watercraft to pull closer to it. The apparatus may additionally be used to grab items out of the water, such as items that have fallen overboard. An important and favorable use may be around areas of boat congestion. This could be around fuel docks where someone extends assistance from the dock to the boats. A person at the dock usually grabs the cleat of an inbound boat to pull it in. Such a person on the dock may now use this docking aid to get the inbound boat pulled closer to the fuel dock to tie off more safely and quickly. This docking aid will give this person greater reach and control, especially in areas of congestion. An apparatus with a self-supporting loop, an elongated shaft and a utility implement with an attached tool such as a hook, is one of the embodiments. As illustrated, the apparatus may comprise a tensile member 20, an elongated shaft 40 and a utility implement 70. The shaft 40 has two ends 50 and 60. Tensile member 20 forms a loop 30. The utility implement 70 may be deployed onto loop 30. Tensile member 20 may be made of a suitably stiff material, such as metal cable in plastic sheathing. It may be designed to have a desired tensile strength so that the loop maintains its form when extended horizontally. The shaft 40 may be made of plastic, such as PVC, or any other suitable material. The utility implement 70 may be held in position by the curvature of the loop 30.

Figure 2:
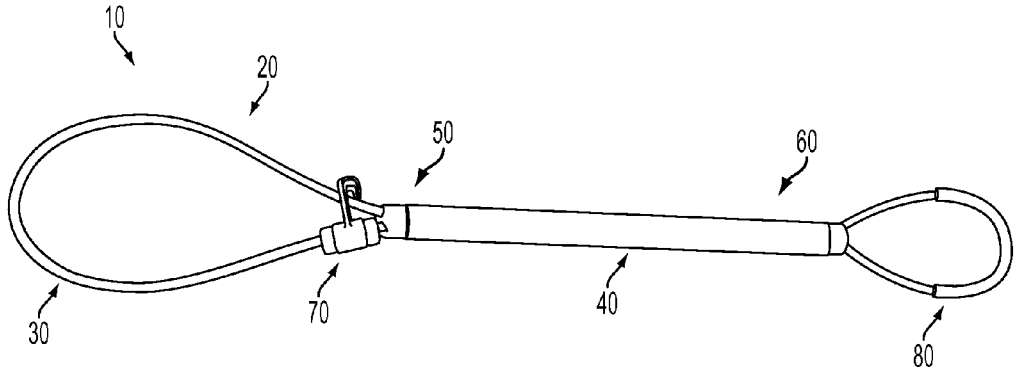
FIG. 2 shows the docking aid apparatus with a loop, a handle and a utility implement with an attached tool—in this case, a hook, in stowed position.

With reference to FIG. 2, a docking aid apparatus 10 may comprise a tensile member 20, a loop 30, an elongated shaft 40, a utility implement 70 and a handle 80. The figure shows the utility implement 70 in stowed position.

Figure 3:
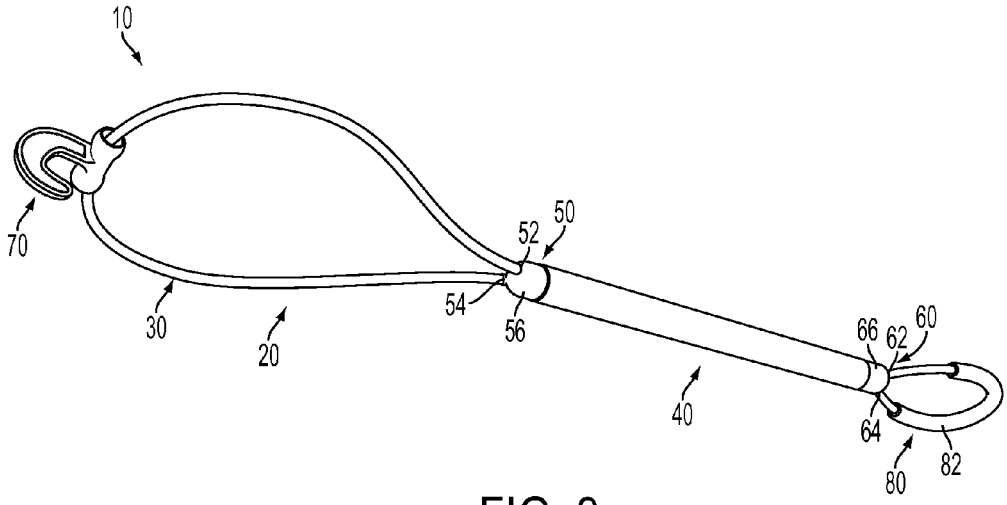
FIG. 3 shows the docking aid apparatus with a shaft with caps at each end, a loop, a padded handle, and a utility implement with an attached tool—in this case, a hook, in deployed position.

With reference to FIG. 3, as illustrated, an embodiment of the docking aid apparatus 10 is shown. It may comprise an elongated shaft 40 and a tensile member 20 that forms a loop 30. Separate sections of the tensile member 20 may extend on either side of the shaft 40 through the two shaft-ends 50 and 60. The shaft-ends 50 and 60 may be additionally capped by caps 56 and 66 respectively. Caps 56 and 66 may be made of the same material as the shaft 40, or other suitable material. Caps 56 and 66 are preferably fixedly attached to the shaft 40 so as to make the interior of the shaft waterproof. Caps 56 and 66 have at least one hole. In the figure, Cap 56 is shown with two holes 52 and 54. The diameters of holes 52 and 54 are substantially the same as the diameter of the tensile member 20. In some embodiments, the tensile member 20 may emerge from the holes 52 and 54 to form a loop 20. Likewise, cap 66 is depicted with two holes 62 and 64. The diameters of holes 62 and 64 are substantially the same as the diameter of tensile member 20. In some embodiments, the tensile member 20 may emerge from the holes 62 and 64 to form a handle 80. Optionally, handle 80 may have a padded portion 82 to provide a good grip. FIG. 3 illustrates how a utility implement 70 may be deployed onto loop 30. The utility implement 70 may be held in position by the curvature of the loop 30.

Figure 4:
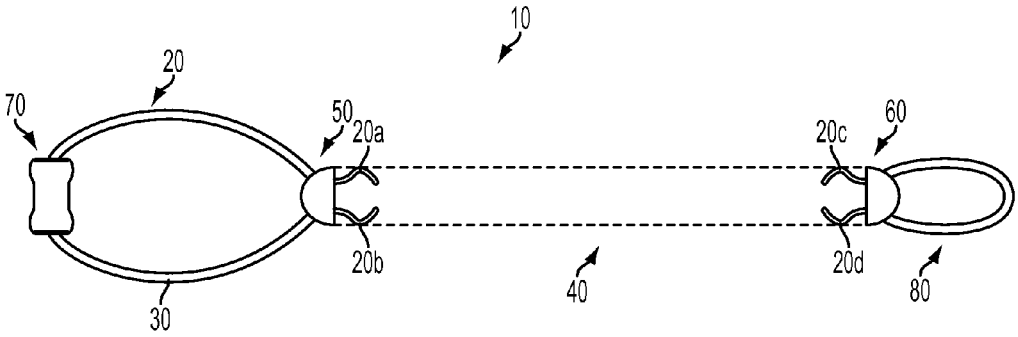
FIG. 4 is a partial cross-sectional view of the apparatus showing the hollow shaft and illustrating how the loop and the handle may be fixed to the shaft.

FIG. 4 is a partial cross-section of the elongated shaft 40. It illustrates how in some embodiments, the sections of tensile member 20 may be fixed onto the body of the elongated shaft 40 to form the loop 30 and a handle 80. One section of tensile member 20 comprises two ends 20*a* and 20*b*. The loop 30 may be formed by fixing these two ends 20*a* and 20*b* to the body of shaft 40 proximate to shaft-end 50. Similarly, a second section of tensile member 20 comprises two ends 20*c* and 20*d*. A handle 80 may be formed by fixing the two ends 20*c* and 20*d* to the body of shaft 40 proximate to shaft-end 60.

Figure 5:
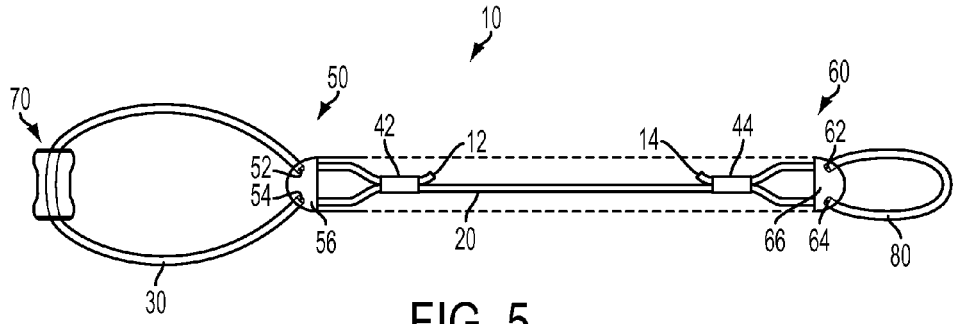
FIG. 5 is a partial cross-sectional view of one embodiment of the apparatus showing the hollow shaft with a cap at each end, and illustrating how the tensile member may pass through the hollow shaft, and the caps to form a loop and a handle.

FIG. 5 is a view of a partial cross-section of the elongated shaft 40. In some embodiments, the shaft 40 may be hollow. In such embodiments, the tensile member 20 may extend through the interior of a hollow shaft 40. The tensile member 20 may extend on either side of the shaft 40 through the shaft-ends 50 and 60. The portion of the tensile member 20 that extends through the shaft-end 50 forms a loop 30. The portion of the tensile member 20 that extends through the shaft-end 60 may form a handle 80. The utility implement 70 may be attached to loop 20. The tensile member-end 12 of tensile member 20 is proximate to shaft-end 50. The tensile member-end 12 is fixed, at least in one embodiment, by crimp 42. The tensile member 20 then emerges from the interior of the shaft 40 through the cap 56 attached to the shaft-end 50. It passes through the hole 52 in cap 56. The tensile member 20 re-enters shaft 40 through hole 54 in cap 56. Thus tensile member 20 forms a loop 30. After loop 30 attains a predetermined size, the portion of tensile member 20 that passes through hole 54 is fixed with crimp 42. The tensile member 20 may extend along the hollow interior of shaft 40. Near shaft-end 60, tensile member 20 is fixed with another crimp 44. It emerges from the interior of shaft 40 through hole 64 in cap 66, which is attached to shaft-end 60. The tensile member 20 re-enters shaft 40 through hole 62 in cap 66. Thus tensile member 20 forms a handle 80. The second end 14 of tensile member 20 is fixed by crimp 44.

Figure 6:
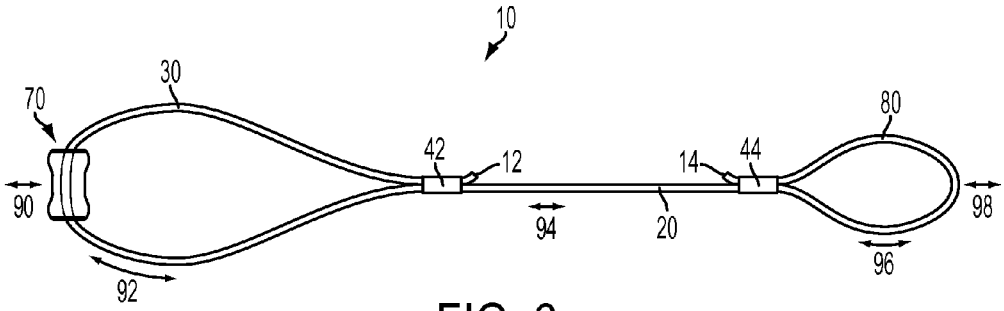
FIG. 6 is a partial cross-sectional view of one embodiment of the apparatus illustrating the transfer of forces along the tensile member.

FIG. 6 is another view showing a partial cross-section of shaft 40. This figure illustrates how in some embodiments, the tensile forces may act on tensile member 20 and how the forces may be distributed along tensile member 20 to maximize the strength of the docking connections, and simultaneously minimize the wear and tear at the weak points of the apparatus. Force 90 represents the force from the docking pole that is exerted on loop 30. It passes along loop 30 as force 92. Part of force 92 is transferred to crimp 42 by the tensile member-end 12. The other portion of force 92 passes through the tensile member 20 as force 94. This is then transferred to force 96 acting on handle 80. Part of force 96 is then passed onto the operator's hand or the other docking element as force 98. The other part of the force 96 is transferred to crimp 44 through tensile member-end 14. In the end, all of the forces must transfer to the hand, i.e. they sum again at the crimp 44.

Figure 7:
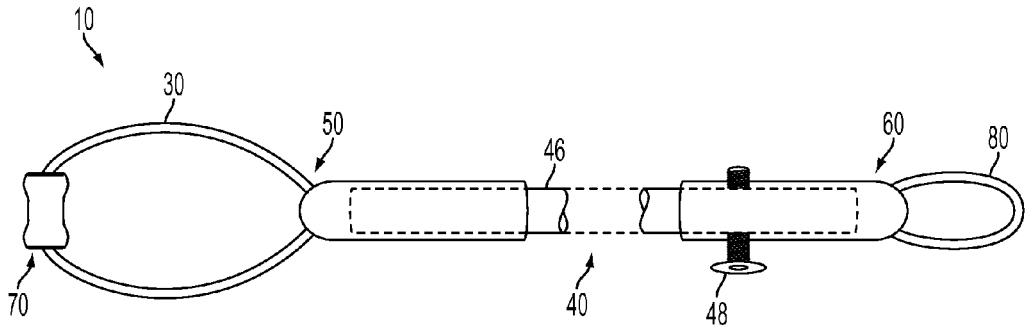
FIG. 7 is a partial cross-sectional view of one embodiment of the apparatus illustrating a telescoping elongated shaft.

FIG. 7 shows an embodiment where elongated shaft 40 has one or more telescoping piping sections 46 to provide the tensile member a desired length. An appropriate friction fit may be used for lighter boats. Other embodiments may be provided with a removable bolt 48 to hold the telescoping sections 46 at a desired length.

Figure 8:
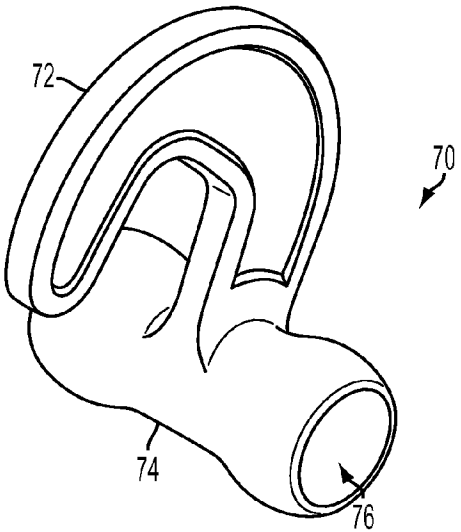
FIG. 8 is a perspective view of a hook.

FIGS. 8, 9, 10 and 11 provide detailed views of one embodiment of a utility implement 70. FIG. 8 shows a perspective view of utility implement 70. It shows the utility tool 72, in this case, a hook, with a substantially cylindrical base member 74. Base member 74 is hollow with an interior bore 76.

Figure 9:
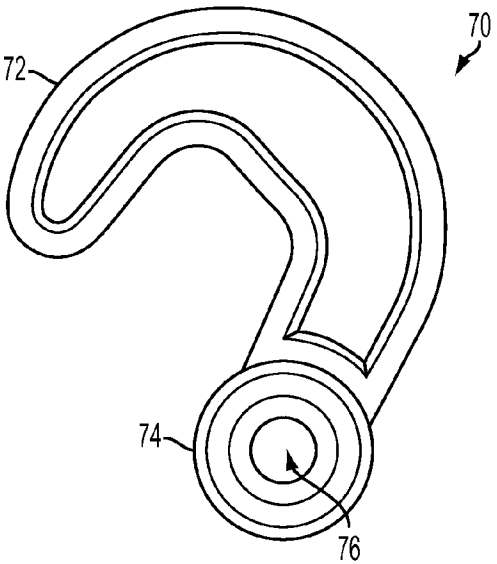
FIG. 9 is a detailed side-view of a hook.

FIG. 9 is a detailed side-view of utility implement 70. It shows utility tool 72, in this case, a hook, and a cross-section of the substantially cylindrical base member 74, and the circular cross-section of the interior bore 76.

Figure 10:
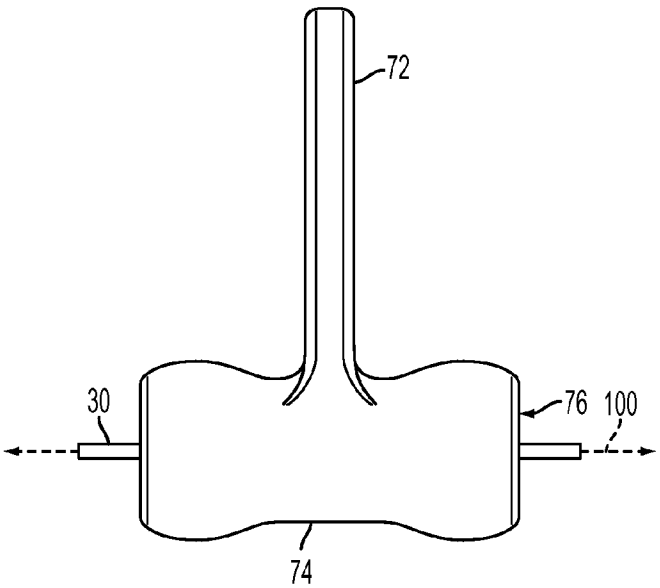
FIG. 10 is a back-view of a hook.

FIG. 10 is a back view of utility implement 70. It illustrates the movement of utility tool 72 with respect to the imaginary x-axis 100, which runs longitudinally along the length of the substantially cylindrical base member 74 of utility implement 70. Loop 30 passes through the interior bore 76 and is shown to lie substantially along the x-axis 100. The base member 74 may rotate about the x-axis 100. This allows the attached utility tool 72 to rotate through all 360° about the x-axis 100, and therefore about the loop 30.

Figure 11:
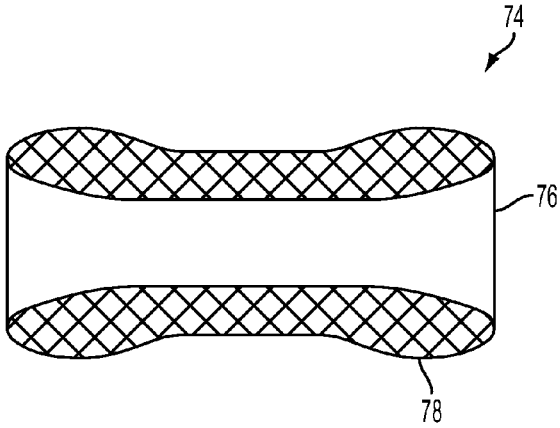
FIG. 11 is a cross-sectional view of the tubular base member of the utility implement.

FIG. 11 shows a cross-sectional view of the tubular base member 74. It shows an interior bore 76 through a casing 78.

Figure 12:
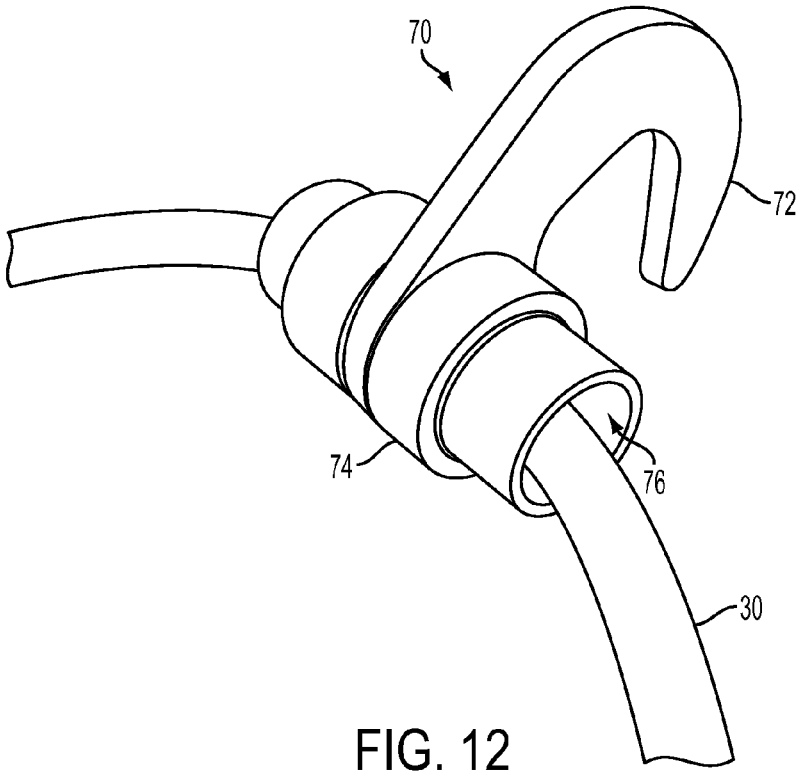
FIG. 12 shows a close-up of the loop to illustrate how the base member may slide along the loop and how the utility tool may be deployed.
Figure 13:
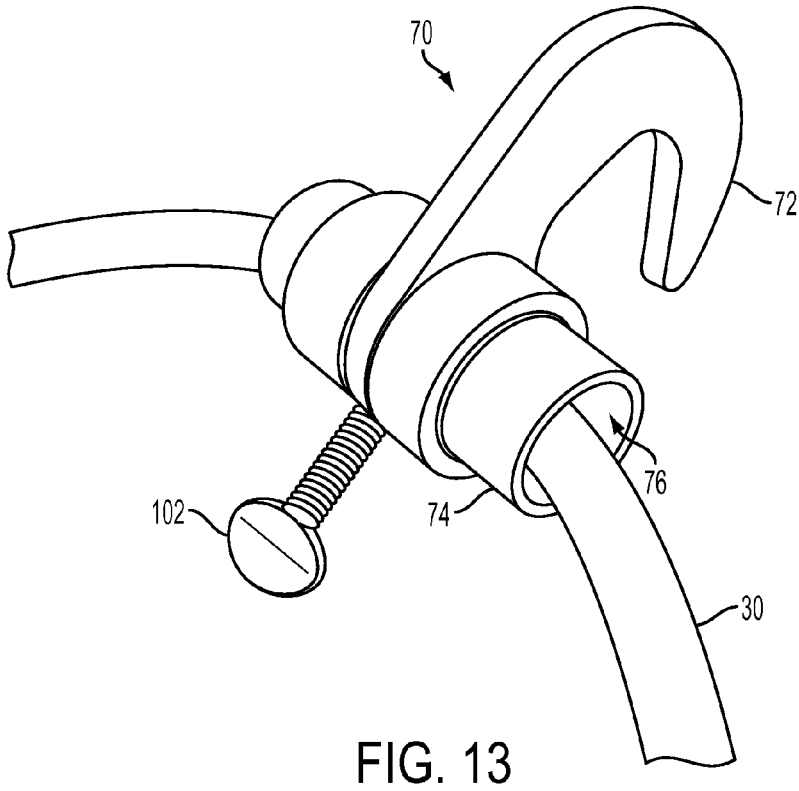
FIG. 13 shows a close-up of the loop to illustrate how the base member may slide along the loop and how the utility tool may be fixed using a clamp such as a thumb screw.

FIGS. 12 and 13 illustrate how a utility implement 70 may be assembled on loop 30. FIG. 12 shows a portion of loop 30 with utility tool 72 in deployed position. Loop 30 passes through the interior bore 76 of base member 74 of utility implement 70. The utility tool 72 is attached to the base member 74. It may be rotated through an angle of 360° to a desired deployed position. The tensile member 20 may be made of such material so that base member 74 may be held in position at a desired angle, by the curvature of the self-supporting loop 30, in combination with the friction between loop 30 and base member 74. Alternatively in some embodiments, as illustrated in FIG. 13, after rotation to select an appropriate orientation, the utility implement 70 may be fixed in place on loop 30 by a clamping device such as a thumb screw 102 that is turned to impinge onto loop 30.

Figure 14:
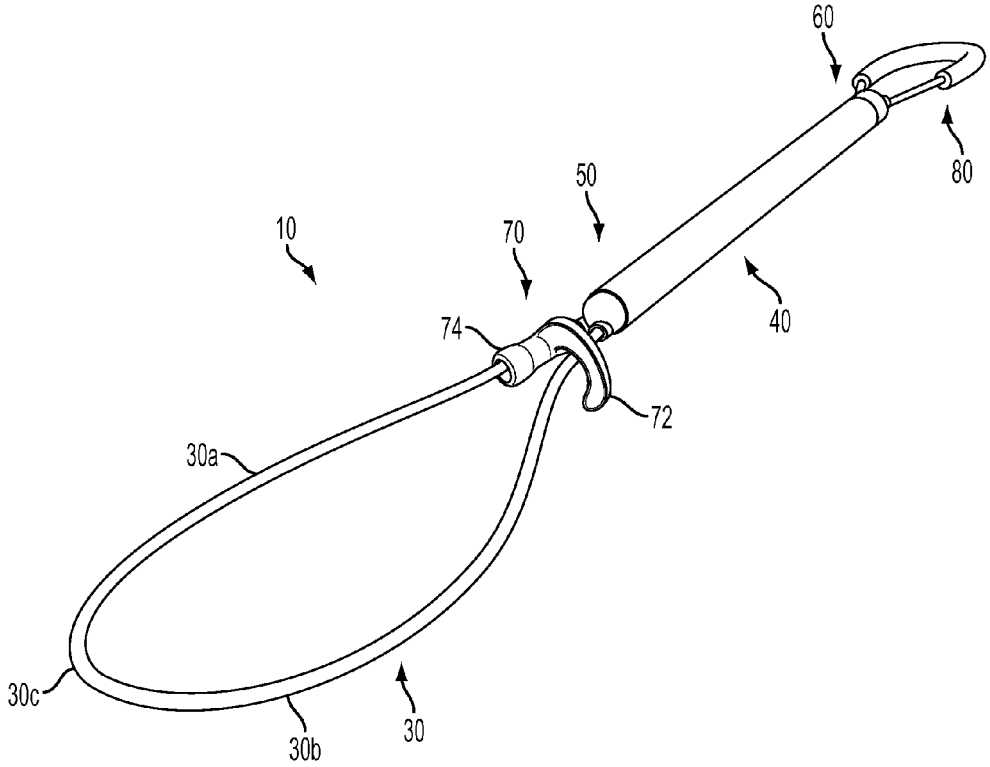
FIG. 14 depicts the hook in stowed position.
Figure 15:
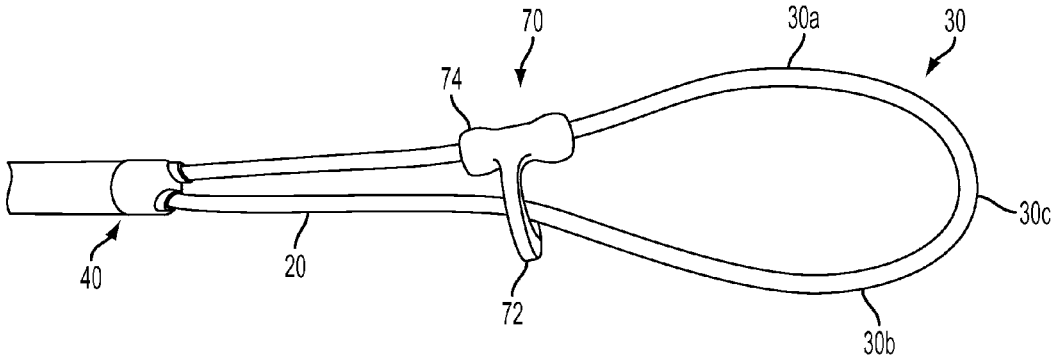
FIG. 15 illustrates how the hook can slide along the tensile member to make the loop smaller.

FIG. 14 illustrates how a particular utility tool 72, in this case a hook, may be kept in stowed position. FIGS. 14 and 15 illustrate how this may also be used to reduce the size of loop 30. In FIG. 14, base member 74 is shown attached to one side 30*a* of loop 30. Base member 74 may slide along side 30*a* of loop 30 toward the top end 30*c* of loop 30. However, hook 72 may engage the other side 30*b* of loop 30, as depicted in FIG. 14. Base member 74 may now slide along loop 30 on side 30*a* while hook 72 engages side 30*b* of loop 30. In this manner, by sliding the base member 74 along side 30*a* of loop 30 toward the top 30*c* of loop 30, utility implement 70 brings together sides 30*a* and 30*b*, thus making loop 30 as small as desired. This is illustrated in FIG. 15.

Instead of a hook, other utility tools may be affixed onto the base member of the utility implement. Such utility tools may include a closable clasp, or a clamp that hooks and unhooks, or a pair of jaw members that close around a mooring member.

In another embodiment, the apparatus may be designed to have neutral buoyancy. This prevents loss of the apparatus if it is dropped into the water.

While many novel features have been described above, the invention is not limited to these physical embodiments. It is described and illustrated with particularity so that that those skilled in the art may understand all other embodiments that may arise due to modifications, changes in the placement of the relative components, omissions and substitutions of these embodiments that are still nonetheless within the scope of this invention.

ADVANTAGES OF THE INVENTION

This apparatus may facilitate docking without assistance from the shore, and without having to disembark to manually aid in the docking Many patents in the art are directed to long-term mooring of the craft, as opposed to acquiring initial contact with a docking element. This apparatus aids acquiring the initial contact by reaching and pulling onto a dock or another boat from a distance, in a safe and controlled manner. An important and favorable use may be around areas of boat congestion. This could be around fuel docks where someone extends assistance from the dock to the boats to get them pulled closer to the fuel dock to tie off more safely and quickly. These uses are achieved both by the firm composition of the loops, the elongated shaft, and may also be achieved by using a telescoping elongated shaft. The embodiment where a tensile member extends through the shaft to form loops at either end of the shaft, allows for direct transmission of the tensile forces acting on the loops, thereby reducing wear and tear at the weak points of the apparatus. The utility implement aids in the multipurpose utility of the apparatus. In one embodiment, a hook is attached as a utility tool. The hook may be used to pull the boat closer to a docking pole or another boat for mooring purposes. The hook may also be used to retrieve objects that have fallen overboard. In at least one embodiment, the hook may be used to adjust the size of the loop. Instead of a hook, other utility tools may be interchangeably attached to the base member of the utility implement. Such tools may be, for example, a clamp that hooks and unhooks; a pair of jaw members that close around a mooring post; or a closable clasp. The invention is simple enough so that the apparatus may be used by any crew member with minimal knowledge of docking procedures. The apparatus is also adaptable to a variety of docking options. The apparatus may be floatable, thus removing the risk of loss when dropped in the water. Moreover, the apparatus is durable, lightweight, and easily stored in the boat.

I claim:

1. A docking aid apparatus for watercraft comprising:

a hollow elongated shaft having a first end and a second end;

a self-supporting loop extending from said first end of said hollow elongated shaft, said self-supporting loop being formed from a tensile member having a first end and a second end, said self-supporting loop being formed by fixing said first end of said tensile member to the body of said tensile member at a first point on said tensile member intermediate of said first and second ends of said tensile member;

a handle extending from said second end of said hollow elongated shaft, said handle being formed by fixing said second end of said tensile member to the body of said tensile member at a second point on said tensile member intermediate of said first and second ends of said tensile member; and a utility implement disposed on said self supporting loop.

2. The docking aid apparatus of claim 1, further comprising:

tubular padding surrounding said handle.

3. The docking aid apparatus of claim 1, wherein:

said utility implement is slidable on said self supporting loop from a stowed position on said self supporting loop to a deployed position on said self supporting loop.

4. The docking aid apparatus of claim 1, wherein:

said utility implement comprises a base member having an aperture sized to fit said tensile member, said self-supporting loop passing through said aperture, said utility implement further comprising a tool attached to said base member.

5. The docking aid apparatus of claim 1, wherein:

said utility implement comprises a tool, said tool selected from the group consisting of;

a hook;

a closable clasp;

a clamp that hooks and unhooks; and a pair of jaw members that close around a mooring member.

6. The docking aid apparatus of claim 5, wherein:

said tool is removable.

7. The docking aid apparatus of claim 1, further comprising;

an end cap on said first end of said elongated shaft, said end cap on said first end of said elongated shaft having at least one aperture to accommodate said self-supporting loop extending from said first end of said elongated shaft.

8. The docking aid apparatus of claim 1, further comprising;

an end cap on said second end of said elongated shaft, said end cap on said second end of said elongated shaft having at least one aperture to accommodate said tensile member.

9. The docking aid apparatus of claim 1, wherein;

said docking aid apparatus has neutral buoyancy.

10. The docking aid apparatus of claim 1, wherein;

said tensile member comprises metal tensile member in plastic sheathing.

11. The docking aid apparatus of claim 1, further comprising:

a handle extending from said second end of said elongated shaft.

12. The docking aid apparatus of claim 1, wherein;

said elongated shaft has multiple, longitudinally adjustable sections to attain a desired length.

13. A docking aid apparatus for watercraft comprising:

an elongated shaft having a first end and a second end;

a self-supporting loop extending from said first end of said elongated shaft, said self-supporting loop being formed from a tensile member, said tensile member having a first end and a second end; and, a utility implement disposed on said self supporting loop; said utility implement comprising a clamp to fix said utility implement in a desired location or orientation on said self-supporting loop.

14. The docking aid apparatus of claim 13, wherein:

said clamp comprises a thumb screw.

* * * * *